US011808025B1

(12) United States Patent
Waldner

(10) Patent No.: US 11,808,025 B1
(45) Date of Patent: Nov. 7, 2023

(54) METHOD FOR ASSEMBLING A BUILDING USING CONCRETE COLUMNS

(71) Applicant: CanAmerican Corrugating Co. Ltd., Margaret (CA)

(72) Inventor: Paul Waldner, Margaret (CA)

(73) Assignee: CanAmerican Corrugating Co. Ltd., Margaret (CA)

( * ) Notice: Subject to any disclaimer, the term of this patent is extended or adjusted under 35 U.S.C. 154(b) by 0 days.

(21) Appl. No.: 17/836,437

(22) Filed: Jun. 9, 2022

(51) Int. Cl.
*E04B 1/20* (2006.01)
*E04B 1/16* (2006.01)

(52) U.S. Cl.
CPC ..... *E04B 1/20* (2013.01); *E04B 1/165* (2013.01); *E04B 1/167* (2013.01)

(58) Field of Classification Search
CPC . E04B 1/16; E04B 1/161; E04B 1/163; E04B 1/165; E04B 1/167; E04B 1/20
See application file for complete search history.

(56) References Cited

U.S. PATENT DOCUMENTS 2,037,482 A * 4/1936 Boone ..... E04B 1/20 52/236.7
4,409,764 A * 10/1983 Wilnau ..... E04B 1/165 52/204.2
6,625,943 B1 * 9/2003 Renner ..... E04B 5/12 52/319
7,083,515 B2 * 8/2006 Rapisarda ..... E04B 5/48 52/220.8
2001/0003234 A1 * 6/2001 Van Doren ..... E04B 1/165 52/250
2004/0172898 A1 * 9/2004 Knepp ..... E02D 27/42 52/294
2012/0233936 A1 * 9/2012 Zhong ..... E04B 1/34823 52/173.1
2014/0197573 A1 * 7/2014 Goss ..... B29C 39/10 264/279.1

FOREIGN PATENT DOCUMENTS

CH 156964 A * 9/1932
FR 908321 A * 4/1946

* cited by examiner

*Primary Examiner* — Christine T Cajilig
(74) *Attorney, Agent, or Firm* — Adrian D. Battison; Ade & Company Inc.; Kyle R. Satterthwaite

(57) ABSTRACT

A concrete and steel insulated building is constructed by forming excavated holes and inserting into each hole a 3-dimensional reinforcing bar cage having a length so as to define reinforcement for a pile and to stand upwardly of the hole to a height above the hole to provide reinforcement for a column having a height of the building wall. The pile is formed by casting concrete into each hole around the cage and setting the material so as to define an upper surface of the pile at or above the ground. With the pile set, a formwork is defined by a series of stacked openable form components standing upwardly and a further body of concrete is cast into the formwork to form the column which is integrated with the pile by the cage. A roof and insulated walls are applied on the building supported by the columns.

20 Claims, 6 Drawing Sheets

METHOD FOR ASSEMBLING A BUILDING USING CONCRETE COLUMNS

This invention relates to a method for assembling a building using concrete columns where the building uses conventional structure used in steel buildings to complete the insulated structure.

BACKGROUND OF THE INVENTION

Steel buildings are typically constructed using concrete piles onto which is mounted a structure formed of assembled steel columns, a roof structure defined by spanning roof trusses and insulated wall panels attached to the columns. This is a very simple and widely used structure

SUMMARY OF THE INVENTION it is an object of the present invention to provide an improved building structure which allows simple erection procedures while creating a structure highly resistant to side loads.

According to the invention there is provided a method for constructing a building comprising:

forming a plurality of excavated holes at spaced locations across an area of ground onto which the building is to be placed;

inserting into each hole a 3-dimensional reinforcing bar cage formed of connected individual bars with the cage having a length so as to extend into the hole and so as to stand upwardly of the hole to a height above the hole;

casting into each hole a settable material to form a pile around the cage and setting the material so as to define an upper surface of the pile at or above the ground and so as to support the cage standing upward from the ground;

with the material set, providing around the upstanding cage a formwork standing upwardly from the upper surface to a position at or adjacent a top of the cage;

and casting into the formwork and onto the upper surface a settable material to form a column containing the cage and standing upwardly from the upper surface of the pile;

providing a roof on the building supported by the columns;

and providing a wall of the building by attaching supporting members to the columns and attaching insulating wall panels so as to span between the columns and attaching insulation sheet materials to the supporting members.

The cage thus formed is defined by a series of reinforcing bars including longitudinal bars and transverse bars welded or connected together to form an integral structure where the structure has a length sufficient to form both the pile and at least a main part of the column. The transverse bars which connect to the longitudinal bars to provide the 3-dimensional structure are arranged to provide the required transverse strength for the pile and the column.

In this structure when completed the roof is preferably supported from the ground only by the columns.

In this structure when completed the roof is preferably located at a top of the columns so that the columns define a height of the roof from the ground.

Preferably a metal beam is located on top of and spans between the columns so as to be carried thereby and extends along a side wall of the building.

The pile may be cast within a form such as a cardboard tube surrounding the cage. Piles are typically poured into hole without a form. Sometimes a steel casing is required temporarily to prevent hole from caving in if there is high ground water or sand.

Preferably the pile is cylindrical and the column is rectangular with a base of the column sitting on the upper surface of the cylindrical pile.

Preferably the pile includes additional transverse reinforcing bars surrounding the cage so that the cage forms a common central portion extending along the full length and additional transverse and longitudinal components to increase the transverse dimension of the cage in the pile section. Thus the additional reinforcing bars are formed as a common structure with the cage for insertion as a common body into the excavated hole.

In some cases the supporting members for the wall panels are attached to the columns on an exterior surface of the columns so that the wall panels forming insulation sheet materials cover the exterior surface.

In other cases, the supporting members are attached to the columns so that the wall panels are located between the columns with the exterior surface of the columns remaining exposed.

Preferably a cast floor is poured for the building up to a stop surface defined at the wall.

In one preferred arrangement, the formwork for the columns is supplied as a plurality of tubular form components which are stacked one on top of the next to create an elongated tubular form surrounding the cage.

In this arrangement preferably each tubular form component can be opened along one edge to wrap around the cage and reconnected when wrapped before being connected to the next. In this way the requirement to feed the separate form components over the top of the cage which can be 20 feet high is avoided.

The vertical walls can form the pile section drilled into the ground to a depth and diameter as determined by the ground structure and building requirements. At the surface of the ground the column is cast in place at a reduced transverse dimension as needed by design. The column is cast using reusable forms defined by metal walls.

The walls are preferably formed by stringing and fastening C-girts or Z-girts which form supporting channel girts and then attaching conventional exterior metal cladding panels of an insulating material. The height of the wall can then be formed using the panels up to a height of whatever it needs or wants to be. Typically single storey buildings having a wall height of 10 feet can be used or in some cases the wall height can be much higher with a height of 20 feet being common.

Conventional roofing systems can be used where the eave and base wall are sealed with optional urethane and insulation add on as required. This can be done at the side walls and also at the gable ends.

The floor is typically a cast concrete floor applied over a gravel layer with floor elevation selected in accordance with the wall location to place and finish the floor with floor drains, heating conduits etc.

The building structure can be completed by a steel W Beam laid on the top of the on which steel rafters or steel joists can be set and attached. The attachment can be made by welding or by use of suitable anchors. To form the insulated wall structure, Z channels can be used to create a cavity for the insulation. Purlins for the roof may be required. The roof panels can then use conventional metal roofing with a standing seam clip which is then zip shut as typically used in a standing seam roof.

The methods described herein provide a building that we can sell that where a majority of the materials can be manufactured off site and when completed is extremely well built with steel and concrete that compete against commercial steel buildings and concrete precast systems. It is believed to provide a system that will be cheaper than both and better than a commercial steel building.

BRIEF DESCRIPTION OF THE DRAWINGS

One embodiment of the invention will now be described in conjunction with the accompanying drawings in which.

In the drawings like characters of reference indicate corresponding parts in the different figures.

DETAILED DESCRIPTION

Figure 1:
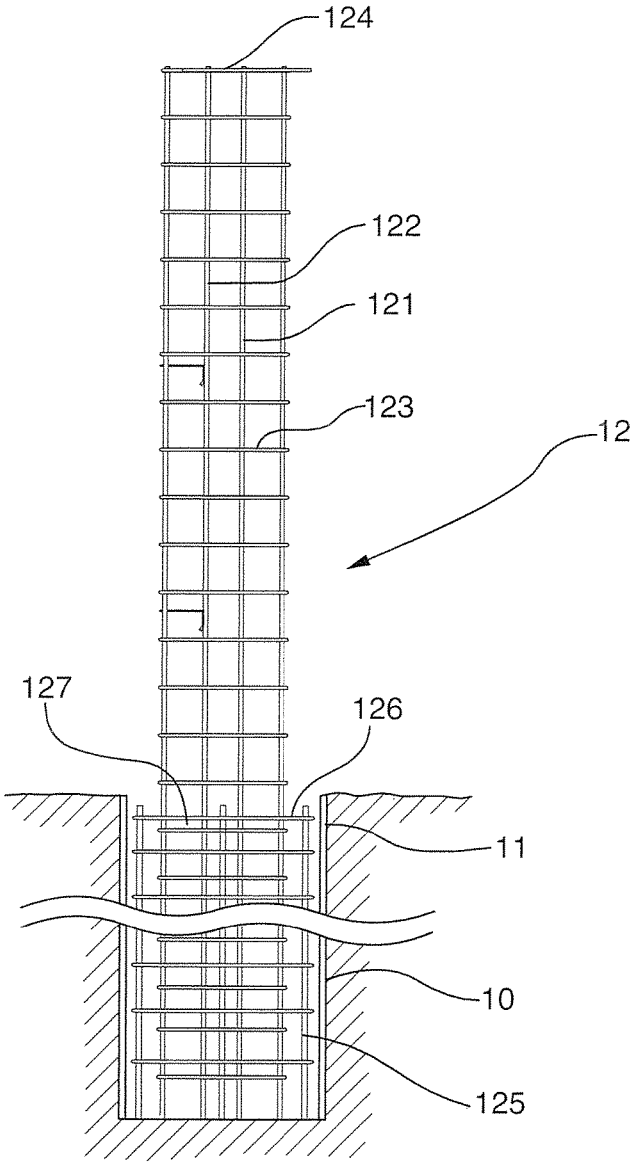
FIG. 1 is a vertical cross-sectional view of a first step in a method of manufacture of a building with concrete columns according to the present invention.
Figure 2:
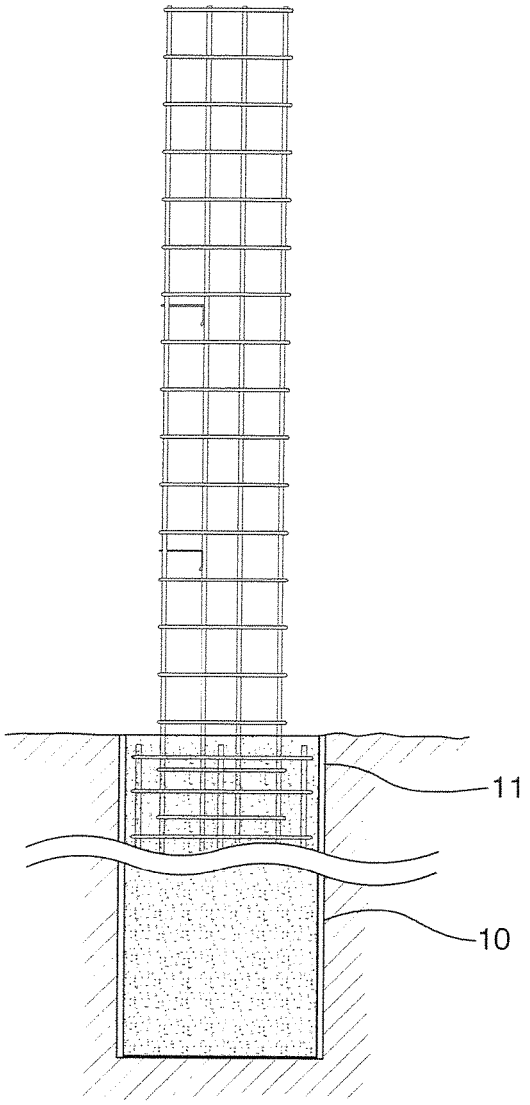
FIG. 2 is a vertical cross-sectional view of a second step in the method of FIG. 1.
Figure 3:
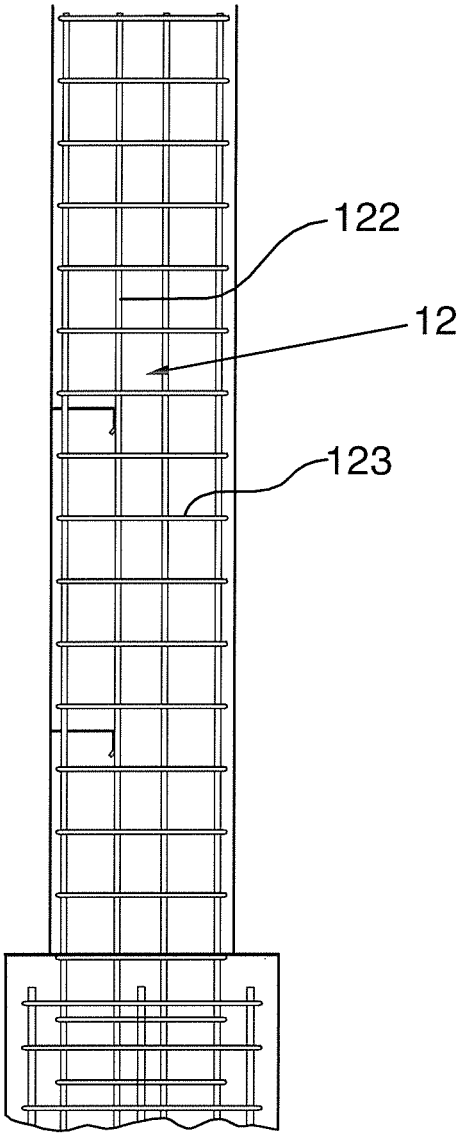
FIG. 3 is a vertical cross-sectional view of a third step in the method of FIG. 1.

The method shown in the drawings for constructing a building includes the steps shown in FIGS. 1 to 3 for forming an array of columns to define side and end walls of the building. The columns are formed by initially drilling an array of excavated holes at spaced locations across an area of ground onto which the building is to be placed. The holes are drilled to a required depth depending on loads and soil conditions so as to define a cylindrical shape for the hole to receive cast concrete. An optional casing 11 can be provided in some cases.

A 3-dimensional reinforcing bar cage 12 is formed of connected individual reinforcing bars including longitudinal bars 121 and 122 and transverse bars 123. The longitudinal bars extend from a top end 124 of the cage to the bottom end 125. Preferably the longitudinal bars are continuous along the full length but they can also be connected end to end by welding. The transverse bars can include hoops 126 which surround external ones of the longitudinal bars to hold the structure as an integral 3 dimensional structure. The transverse bars can also include inner hoops which wrap around inner ones of the bars. Simple straight interconnecting transvers bars can also be included to provide additional strength if required. The integrated cage thus formed has a length so as to extend into the hole 10 and so as to stand upwardly of the hole to a height above the hole sufficient to define the reinforcement for the length of the column to be formed. Typical lengths therefore can be 20 feet even up to 50 feet where the pile section might be 20 feet and the column section might be between 10 and 30 feet depending on requirements for the building.

Figure 4:
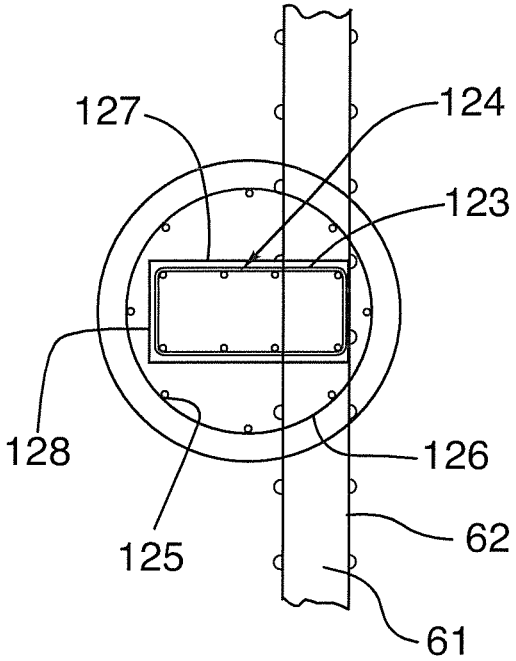
FIG. 4 is plan view of the building at the base of the column and showing the wall panels attached.

The reinforcing bars in the column section thus form a rectangular cage as best shown in FIG. 4 where the longitudinal bars are arranged around the edges of a rectangle having longer sides 127 and shorter sides 128 to form a rectangular column. The use of a rectangular column with the longer sides transverse to the walls of the building provides increased strength in the transverse direction. However the cage and the column thus formed can be square or can be circular or even other shapes such as elliptical. The reinforcing bars in the rectangular shape formed for the column which define a main body of the cage also extend into the pile section and are surrounded by additional longitudinal bars 125 and 126 which are attached to the main body of the cage by additional transverse bars. The additional bars in the pile section form a cylindrical cage portion surrounding the inner main body of the cage so as to define reinforcements which are located at the periphery of the pile when cast.

The additional reinforcing bars located in the pile section thus are formed as a common structure with the cage for insertion as a common body into the excavated hole.

In a second step of the method, a settable material typically concrete is cast into each hole to form a pile around the cage. The concrete is formed into a cylindrical body surrounding the reinforcing bars within the hole and the material is allowed to set with the material filled and levelled to the top of the tube so as to define an upper surface of the pile at or above the ground. The cast material acts to support the cage standing upward from the ground. During installation and casting, the cage is typically supported by suitable supports to hold it vertical such as formwork or a suspension system such as a crane.

With the material in the pile section set, a formwork is created around the upstanding cage standing upwardly from the upper surface to a position at or adjacent a top of the cage. A further body of concrete is cast into the formwork and onto the upper surface to form the column containing the cage and standing upwardly from the upper surface of the pile.

The pile is thus cylindrical and the column is rectangular with a base of the cast column sitting on the upper surface of the cylindrical pile. The structure is integrated and reinforced by the integral cage which extends through both part of the structure.

Figure 5:
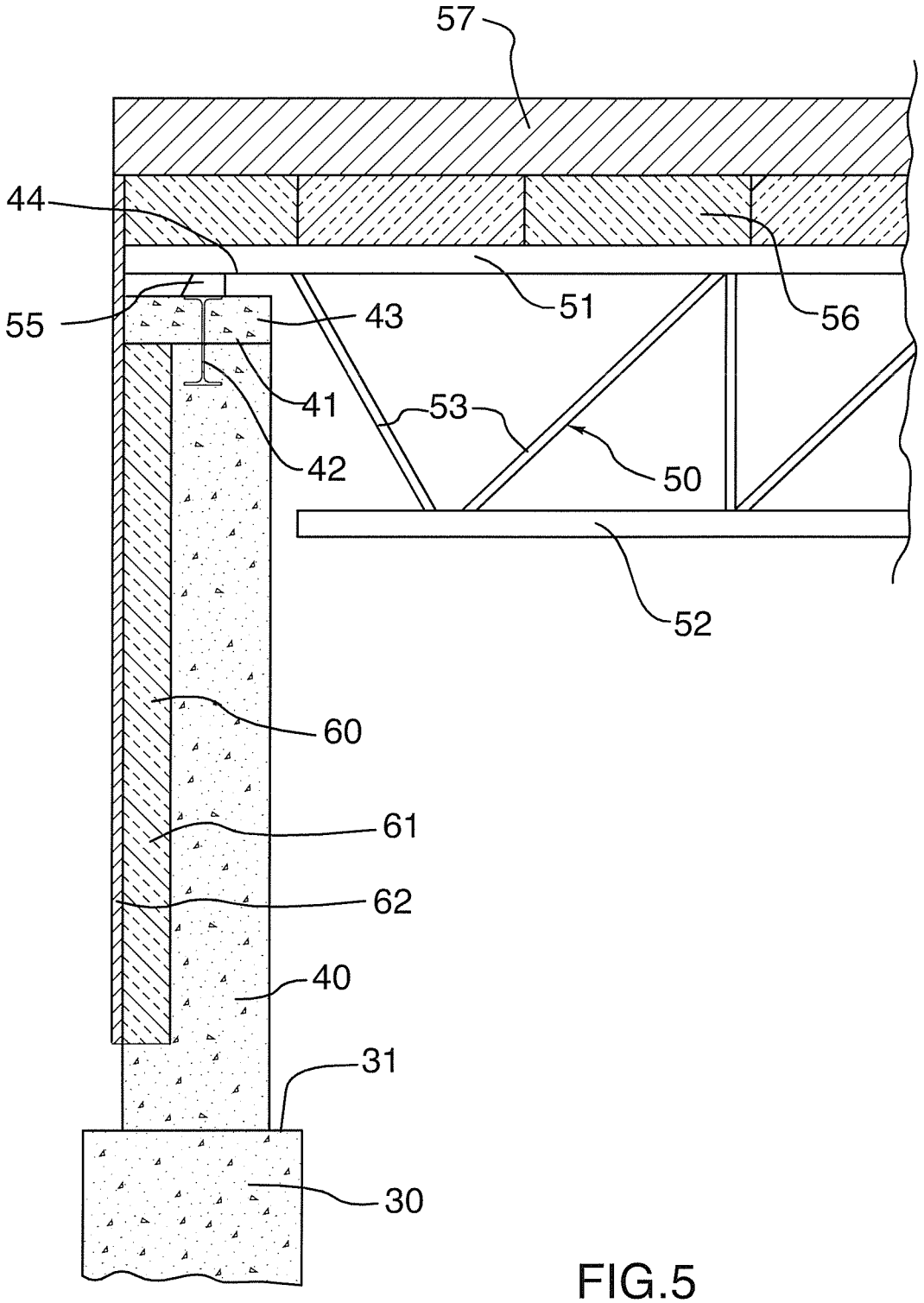
FIG. 5 is a vertical cross-sectional view of the building at a position offset from the column including a wall structure and roof structure applied to the columns formed by the method of FIG. 1.

The structure thus formed is shown in FIG. 5 including the pile shown at 30 and the column shown at 40. The pile has a top surface 31 on which he lower end of the column sits.

The building can then be finished as described above using conventional roofing and wall techniques. As shown, a top steel W beam 42 is located at the upper end 41 of the column 40 and is cast into a top concrete cap 43 of the column so as to span from each column to the next. This provides a top flat pad 44 of the W beam along each side of the building onto which roof trusses 50 can be applied. Thus each roof truss has a top chord 51, a bottom chord 52 and intervening webs 53. The top chord 51 has a lower abutment 55 which sits on the top pad of the beam 42.

On top of the chord 51 is applied an insulation layer 56 and a conventional covering 57 typically of seamed steel panels. The roof is thus supported from the ground only by the columns and is located at a top of the columns so that the columns define a height of the roof from the ground. The beam 42 is located on top of and spans between the columns so as to be carried thereby and extends along a side wall of the building.

A wall structure 60 is provided by insulation 61 and a cladding layer 62. The panels 62 are carried on the columns by Z-girts fastened to the columns onto which the panels are mounted. A metal liner panel is attached to the Z girts to form the interior wall surface.

In some cases the supporting members for the wall panels are attached to the columns on an exterior surface of the columns so that the insulation sheet materials cover the exterior surface. In other cases the supporting members are attached to the columns so that the insulation sheet materials are located between the columns with the exterior surface of the columns remaining exposed. In FIGS. 4 and 5, the cladding covers the columns the but the insulation panels are located between the columns.

Figure 6:
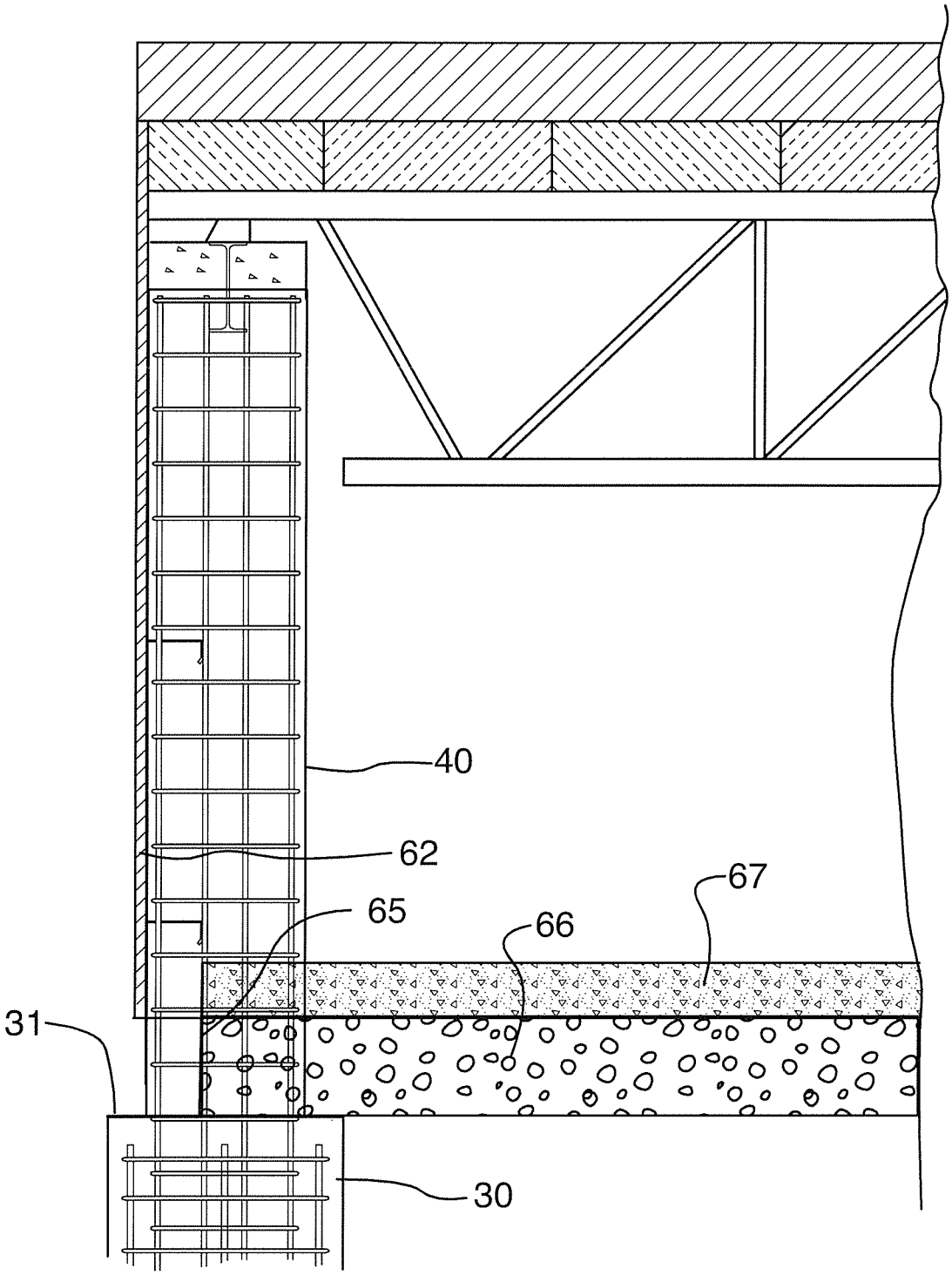
FIG. 6 is a vertical cross-sectional view of the building at a position aligned with the column including a roof structure applied to the columns and a floor poured at a base of the columns formed by the method of FIG. 1.
Figure 7:
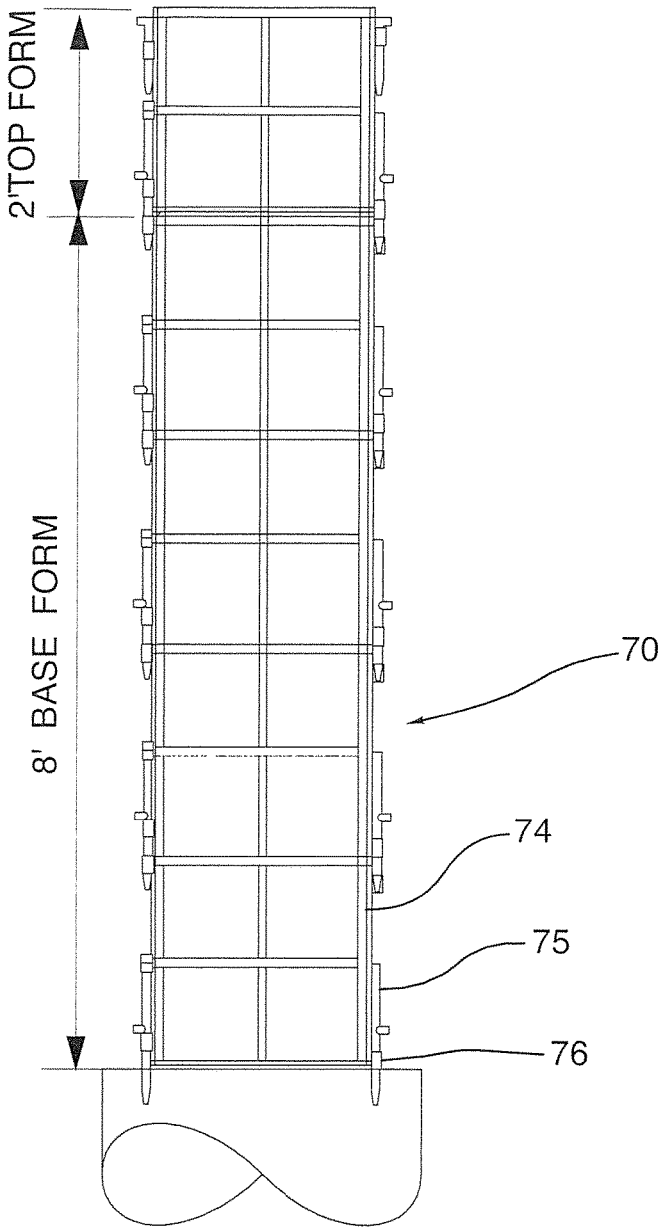
FIG. 7 is a vertical cross-sectional view through a first embodiment of form work for casting the columns in the method of FIG. 1.

As shown in FIG. 6 a cast concrete floor is poured for the building up to a sheet metal stop surface 65 defined at the wall and located on the top surface 31 of the column 30. The height of the bottom of the wall is arranged relative to the top of the pile so as to provide sufficient space to receive a gravel layer 66 onto which the concrete floor 67 is poured and levelled to the bottom of the wall.

As shown in FIGS. 7 to 12, the formwork 70 for the column is supplied as a plurality of tubular form components 71 which are stacked one on top of the next to create an elongate tubular form surrounding the cage.

Figure 8:
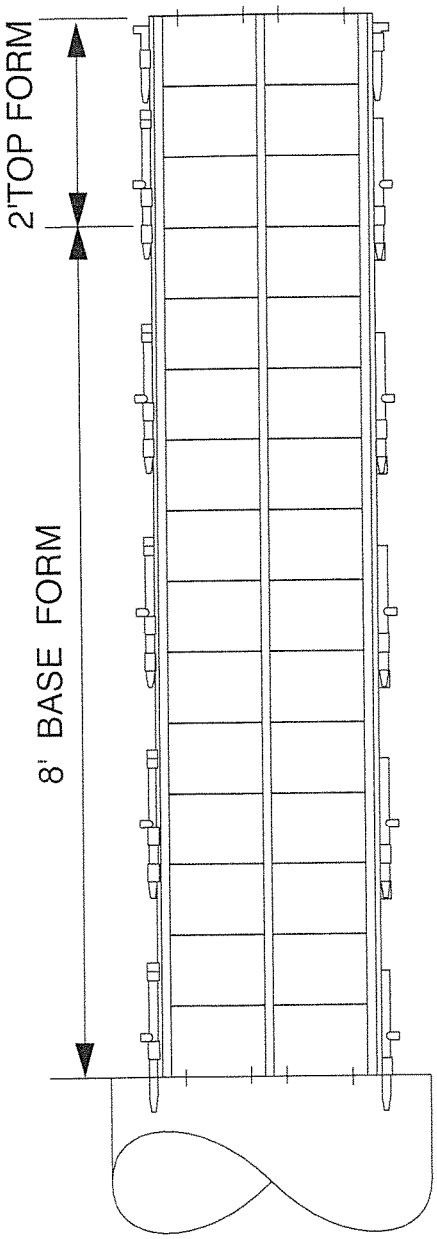
FIG. 8 is a vertical cross-sectional view through a second embodiment of form work for casting the columns in the method of FIG. 1.
Figure 9:
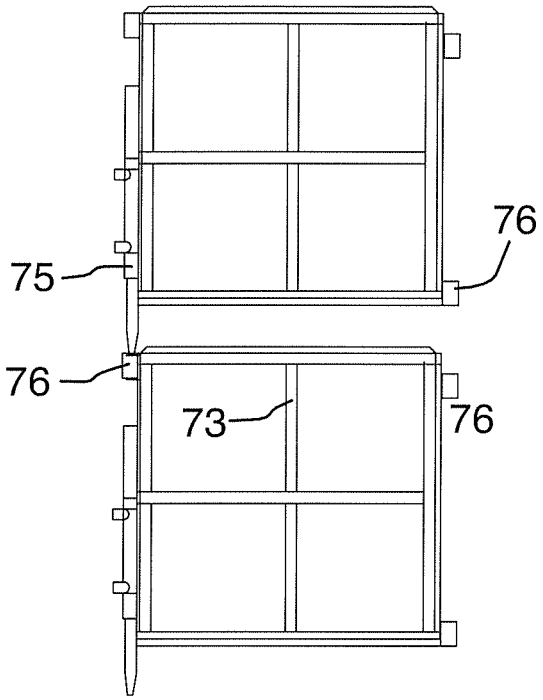
FIG. 9 is a vertical cross-sectional view through the form work of FIG. 7 showing the individual components in separate position prior to assembly for casting the columns in the method of FIG. 1.
Figure 10:
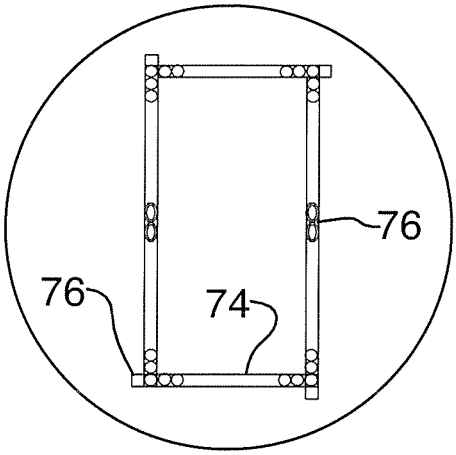
FIG. 10 is a top plan view of the form work of for use in forming the rectangular column shown in FIG. 4.
Figure 11:
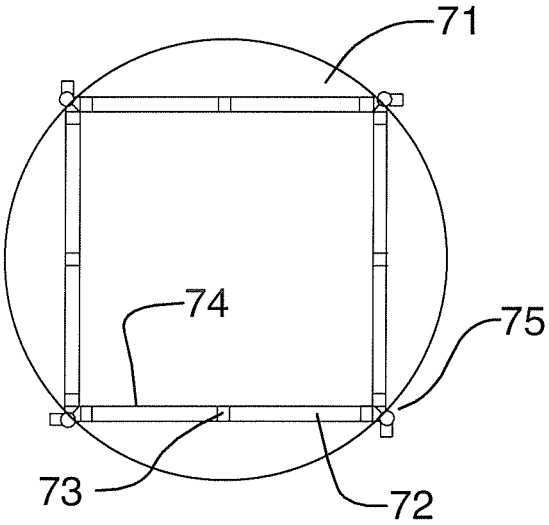
FIG. 11 is a top plan view of the form work of for use in forming the a square column.
Figure 12:
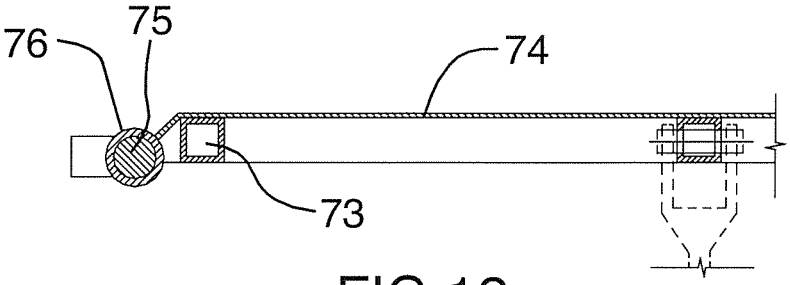
FIG. 12 is a horizontal cross-sectional view of one side wall part of the form work shown in FIG. 9.

As shown in FIG. 11, each form component 71 is defined by four sides 72 fabricated from tubular support frame elements 73 and a liner layer 74 to enclose the concrete. The four sides are connected together at corners by pins 75 which engage into receiving sleeves 76 to lock each side to its neighbour. The removal of the pin at one corner allows each tubular form component to be opened to wrap around the cage before being connected to the next rather than to be passed over the top of the cage. Each form component has a lower edge which sits on top of the next adjacent component with the pins extending into sleeves on each component so as to bridge the junction between the two components and hold them aligned. As shown in FIGS. 8 and 10 the sides of the components can be formed from separate pieces connected together at junctions or connectors so as to allow forms of a required dimension to be fabricated Since various modifications can be made in my invention as herein above described, and many apparently widely different embodiments of same made within the spirit and scope of the claims without department from such spirit and scope, it is intended that all matter contained in the accompanying specification shall be interpreted as illustrative only and not in a limiting sense.

The invention claimed is:

1. A method for constructing a building comprising:

forming a plurality of individual excavated holes each separated from and spaced from a next adjacent hole at spaced locations across an area of ground onto which the building is to be placed;

inserting into each individual excavated hole a 3-dimensional reinforcing bar cage formed of connected individual bars with the cage having a length so as to extend into the individual excavated hole and so as to stand upwardly of the individual excavated hole to a height above the individual excavated hole;

casting into each individual excavated hole a settable material to form a pile around the cage and setting the material so as to define an upper surface of the pile at or above the ground and so as to support the cage standing upward from the ground;

with the material set, providing around the upstanding cage a formwork standing upwardly from the upper surface to a position at or adjacent a top of the cage;

casting into the formwork and onto the upper surface a settable material to form a column containing the cage and standing upwardly from the upper surface of the pile;

providing a roof on the building supported by the columns;

and providing a wall of the building by attaching supporting members to the columns and attaching reinforcing boards so as to span between the columns and attaching insulation sheet materials to the supporting members.

2. The method according to claim 1 wherein the roof is supported from the ground only by the columns.

3. The method according to claim 1 wherein the roof is located at a top of the columns so that the columns define a height of the roof from the ground.

4. The method according to claim 1 wherein a beam is located on top of and spans between the columns so as to be carried thereby and extends along a side wall of the building.

5. The method according to claim 4 wherein the beam is metal.

6. The method according to claim 4 wherein the roof is carried on the beam.

7. The method according to claim 1 wherein the pile is cast within a form surrounding the cage.

8. The method according to claim 1 wherein the pile is cylindrical and the column is rectangular with a base of the column sitting on the upper surface of the cylindrical pile.

9. The method according to claim 1 wherein the pile includes additional reinforcing bars surrounding the cage.

10. The method according to claim 9 wherein the additional reinforcing bars are formed as a common structure with the cage for insertion as a common body into the excavated hole.

11. The method according to claim 1 wherein the supporting members are attached to the columns on an exterior surface of the columns so that the insulation sheet materials cover the exterior surface.

12. The method according to claim 1 wherein the supporting members are attached to the columns so that the insulation sheet materials are located between the columns with the exterior surface of the columns remaining exposed.

13. The method according to claim 1 wherein a cast floor is poured for the building up to a stop surface defined at the wall.

14. The method according to claim 1 wherein the formwork is supplied as a plurality of tubular form components which are stacked with one tubular form component on top of a previous tubular form component to create an elongate tubular form surrounding the cage.

15. The method according to claim 14 wherein each tubular form component can be opened to wrap around the cage before being connected to the previous tubular form component.

16. A method for constructing a building comprising:

forming a plurality of excavated holes at spaced locations across an area of ground onto which the building is to be placed;

inserting into each hole a 3-dimensional reinforcing bar cage formed of connected individual bars with the cage having a length so as to extend into the hole and so as to stand upwardly of the hole to a height above the hole;

casting into each hole a settable material to form a pile around the cage and setting the material so as to define an upper surface of the pile at or above the ground and so as to support the cage standing upward from the ground;

with the material set, providing around the upstanding cage a formwork standing upwardly from the upper surface to a position at or adjacent a top of the cage;

casting into the formwork and onto the upper surface a settable material to form a column containing the cage and standing upwardly from the upper surface of the pile;

providing a roof on the building supported by the columns;

and providing a wall of the building by attaching supporting members to the columns and attaching reinforcing boards so as to span between the columns and attaching insulation sheet materials to the supporting members;

wherein the supporting members are attached to the columns on an exterior surface of the columns so that the insulation sheet materials cover the exterior surface.

17. The method according to claim 16 wherein the formwork is supplied as a plurality of tubular form components which are stacked with one tubular form component on top of a previous tubular form component to create an elongate tubular form surrounding the cage.

18. The method according to claim 17 wherein each tubular form component can be opened to wrap around the cage before being connected to the previous tubular form component.

19. A method for constructing a building comprising:

forming a plurality of excavated holes at spaced locations across an area of ground onto which the building is to be placed;

inserting into each hole a 3-dimensional reinforcing bar cage formed of connected individual bars with the cage having a length so as to extend into the hole and so as to stand upwardly of the hole to a height above the hole;

casting into each hole a settable material to form a pile around the cage and setting the material so as to define an upper surface of the pile at or above the ground and so as to support the cage standing upward from the ground;

with the material set, providing around the upstanding cage a formwork standing upwardly from the upper surface to a position at or adjacent a top of the cage;

wherein the formwork is supplied as a plurality of tubular form components which are stacked with one tubular form component on top of a previous tubular form component to create an elongate tubular form surrounding the cage;

casting into the formwork and onto the upper surface a settable material to form a column containing the cage and standing upwardly from the upper surface of the pile;

providing a roof on the building supported by the columns;

and providing a wall of the building by attaching supporting members to the columns and attaching reinforcing boards so as to span between the columns and attaching insulation sheet materials to the supporting members.

20. The method according to claim 19 wherein each tubular form component can be opened to wrap around the cage before being connected to the previous tubular form component.

* * * * *